US008397808B2

(12) United States Patent
Khomynets

(10) Patent No.: US 8,397,808 B2
(45) Date of Patent: Mar. 19, 2013

(54) BORE-HOLE JET DEVICE FOR FORMATION HYDRAULIC FRACTURING AND HORIZONTAL WELL EXAMINATION AND A METHOD FOR THE OPERATION THEREOF

(76) Inventor: Zinoviy Dmitrievich Khomynets, Moscow (RU)

( * ) Notice: Subject to any disclaimer, the term of this patent is extended or adjusted under 35 U.S.C. 154(b) by 316 days.

(21) Appl. No.: 12/680,546

(22) PCT Filed: Apr. 17, 2008

(86) PCT No.: PCT/RU2008/000236

§ 371 (c)(1),
(2), (4) Date: Mar. 26, 2010

(87) PCT Pub. No.: WO2009/048351

PCT Pub. Date: Apr. 16, 2009

(65) Prior Publication Data

US 2010/0243256 A1 Sep. 30, 2010

(30) Foreign Application Priority Data

Oct. 10, 2007 (RU) ..... 2007137406

(51) Int. Cl.
*E21B 47/06* (2012.01)

(52) U.S. Cl. ..... 166/250.01; 166/106; 166/372

(58) Field of Classification Search ..... 166/66, 166/68, 105.1, 106, 177.5, 250.01, 250.07, 166/305.1, 372
See application file for complete search history.

(56) References Cited

U.S. PATENT DOCUMENTS

| | | | | |
|---|---|---|---|---|
| 4,605,069 | A * | 8/1986 | McClaflin et al. | 166/310 |
| 2008/0115934 | A1 * | 5/2008 | Pettinato et al. | 166/254.1 |

FOREIGN PATENT DOCUMENTS

| | | | |
|---|---|---|---|
| RU | 2121610 | C1 | 11/1998 |
| RU | 2176336 | C1 | 11/2001 |
| RU | 2246049 | C1 | 2/2005 |
| RU | 2256103 | C1 | 7/2005 |
| RU | 2303171 | C1 | 7/2007 |
| WO | 2006/001734 | A1 | 1/2006 |

* cited by examiner

*Primary Examiner* — Giovanna Wright
*Assistant Examiner* — Richard Alker
(74) *Attorney, Agent, or Firm* — patenttm.us

(57) ABSTRACT

A jet pump body comprises nozzle and mixing chamber with diffuser, coaxially arranged, and a stepped through channel, tapers downward and provided with a seat between steps. The channel is made coaxially with a pipe string. Channels provided with return valve and restrictor for limiting locking member displacement of the return valve upward respective to the seat. A hollow stepped sealing unit with sealing element can be arranged in the through channel. An axial channel is made in the sealing element. A guiding separation bushing cantilever fitted by the top end thereof to the top part of the body of the pump mounts above the channel axially thereto in the pump body. Longitudinal slotted orifices are made in the separation bushing wall.

4 Claims, 4 Drawing Sheets

BORE-HOLE JET DEVICE FOR FORMATION HYDRAULIC FRACTURING AND HORIZONTAL WELL EXAMINATION AND A METHOD FOR THE OPERATION THEREOF

FIELD OF THE INVENTION

The invention relates to the field of pump engineering, primarily to bore-hole jet devices for formation hydrofracturing, well testing and surveying.

BACKGROUND ART

A bore-hole jet device is known that comprises a packer provided with a central channel and a jet pump which body is provided with an active nozzle and a mixing chamber with a diffuser as well as a channel for supplying a working medium and a channel for supplying a fluid pumped out of a well, the packer and the pump being arranged on a pipe string, the jet pump body being also provided with a pass channel with the possibility of installing replaceable functional inserts and a sealing unit therein (see, RU Patent No. 2176336 C 1, F04F 5/02, Nov. 27, 2001).

The same patent teaches a method for operating a bore-hole jet device, including arranging the jet pump on a flow string in a well, pumping a chemical agent via the flow string into a formation and subsequently pumping reaction products out of the formation, initially a blocking insert with a pass channel being installed into the pass channel made in the jet pump body, then the blocking insert being replaced with a depression insert and after that a working medium being supplied via the flow string into the jet pump nozzle, thus creating an adjustable bottom-hole pressure in the under packer area and securing the possibility of draining the formation and carrying out other maintenance works.

This bore-hole jet device enables to treat a formation below the level of the jet pump in a well, including creation a pressure differential between the areas above and below the sealing unit. However, the possibilities of this bore-hole jet device are not used in full because a big timetable is required for replacement of inserts, which is often greater than an estimated time of reactions between an acid solution and minerals of a producing formation.

The closest to the claimed device as a subject of the invention in respect of the technical essence and the achieved effect is a bore-hole jet device comprising a packer with a central channel and a jet pump with an active nozzle, a mixing chamber and a pass channel having a seat for installing a sealing unit with an axial channel, which are arranged on a flow string, the device being provided with a transmitter and a receiver-transformer of physical fields, which are arranged in the under-packer area on the side where a fluid pumped out of a well enters the jet pump and are mounted on a logging cable passing through the axial channel of the sealing unit (see, RU Patent No. 2121610, F04F 5/02, Nov. 10, 1998).

The same patent teaches a method for operating the bore-hole jet device, including arranging a jet pump with a pass channel and a packer on a flow string, lowering the assembly into a well, releasing the packer and creating a required depression in the under-packer area by pumping a fluid out of the under-packer area with the use of the jet pump.

This bore-hole jet device and the method for operating it enable to carry out various production operations in a well below the level of the jet pump, including those carried out after reducing a pressure differential between the areas above and below the sealing unit. However, this device does not enable using its possibilities in full, since it allows to carry out surveys of producing rocks only in well bores that are nearly vertical, thus narrowing the applications of the claimed method and the bore-hole jet device proposed for implementing it. Moreover, a rather labor-consuming operation on releasing the packer and subsequently installing it in a new place is, as a rule, required for rearranging the jet pump, which increases the time necessary for carrying out full-scale surveys.

SUMMARY OF THE INVENTION

The objective of the invention is to intensify works on surveying, testing and preparing wells, first of all horizontal wells and wells having a great curvature.

The technical effect achieved by this invention is to improve reliability and productivity of the claimed bore-hole jet device when testing a well and optimize operational sequence during surveying and testing a well.

The said objective in respect of the device as a subject of the invention can be reached, and the technical effect can be achieved, due to that the claimed bore-hole jet device for formation hydrofracturing and surveying horizontal wells comprises a jet pump and a packer, which are arranged on a pipe string, an active nozzle and a mixing chamber with a diffuser being coaxially arranged in the jet pump body, the latter being also provided with a stepped pass channel narrowing from top downwards and having a seat between its steps, a channel for supplying a fluid pumped out of a well in communication with the stepped pass channel below the seat, and a channel for supplying an active working medium in communication on its outlet side with the active nozzle and on its inlet side with the hole annulus around the pipe string, the stepped pass channel being made coaxially to the pipe string and communicating with it, the channel for supplying a fluid pumped out of a well and the channel for supplying an active working medium being each provided with a check valve and with a limit stop for the check valve shutoff member, e.g., a ball, when it moves upward relative to the check valve seat, the stepped pass channel being made with the possibility of installing a sealing unit made as a hollow stepped cylindrical housing covering a sealing element, the sealing element being provided with an axial channel for passing a rigid logging cable through it, on which a logging instrument is suspended via a cable head below the jet pump body, a cylindrical guide separation bush is arranged above the stepped pass channel and coaxially to it in the jet pump body, which bush is cantilever-attached by its top end to the top portion of the jet pump body with the use of a threaded connection, longitudinal slit-like openings are made in the wall of the guide separation bush, the lower free end of the guide separation bush being from the upper end of the stepped pass channel at a distance S equal to 0.05-0.2 diameters $D_1$ of the upper end of the stepped pass channel, the inner diameter d of the guide separation bush being equal to 1.05 to 1.2 diameters $D_1$ of the upper end of the stepped pass channel, and the width h of the slit-like openings in the guide separation bush being not greater than the distance H between the adjacent slit-like openings, the diameter $D_2$ of the pass channel below the seat being in the range from 0.90 to 0.96 of the diameter $D_1$ of the upper end of the stepped pass channel, and the diameter $D_3$ of the rigid logging cable being in the range from 0.2 to 0.7 of the diameter $D_1$ of the upper end of the stepped pass channel.

The stepped pass channel is made with the possibility of passing a flexible tube through it via a pipe string down to the well bottom.

The said objective in respect of the claimed method as a subject of the invention can be reached, and the technical effect can be achieved, due to that the method of operating the bore-hole jet device for formation hydrofracturing and surveying horizontal wells includes assembling a pipe string by arranging a jet pump and a packer on the pipe string, lowering the assembly into a well and releasing the packer, then a hydrofracturing liquid or a chemical agent, e.g., an acid solution, is pumped via the pipe string and the stepped pass channel of the jet pump, after that a flexible tube is passed through the pipe string to the well bottom, and a liquid is pumped through the flexible tube for washing unattached propant from the well bottom. Then the flexible tube is removed from the well, and a sealing unit put on a rigid logging cable and a logging instrument attached to the rigid logging cable via a cable head are lowered into the well. The sealing unit is installed on the seat in the jet pump stepped pass channel, and during lowering the logging instrument it is used for registering background values of geophysical fields, in particular thermal fields, from the inlet funnel of the pipe string to the bottom of the horizontal well. Then the logging instrument is positioned in the area of that producing formation in the well, and a pressure drawdown to a producing formation is created with the use of the jet pump by supplying a working medium via the hole annulus around the pipe string to the active nozzle, thus draining the producing formation by removing the hydrofracturing liquid with unattached propant or reaction products resulting from treating the formation with a chemical agent, e.g., with an acid solution, during draining a bottom pressure and a well flow rate are regularly measured. Then the logging instrument on the rigid logging cable is raised to the inlet funnel of the pipe string, measuring current values of physical fields in rocks and of a formation fluid coining into the well, then while the jet pump is operated, the logging instrument is lowered and raised at least three times at different values of pressure drawdown to the formation, and current values of the physical fields in rocks and of the formation fluid coining into the well are registered, the said parameters being registered at different pressures of the working medium supply to the active nozzle and at different lowering and raising speeds of the logging instrument. Then the logging instrument is positioned in the area of the producing formation, the supply of the working medium into the jet pump active nozzle is abruptly stopped, thus ensuring closure of the check valves and separating the above-packer hole annulus and the inner cavity of the pipe string above the sealing unit from the under-packer area, and the logging instrument is used for registering formation pressure restoration curves in the well space under the packer, registration results are used for making a conclusion on preparedness of the well for being transferred into the operation mode, and then the logging instrument together with the sealing unit are removed from the well by using the rigid logging cable.

After removing the logging instrument from the well, the rigid logging cable may be used for lowering an ultrasonic transmitter into the well for the purpose of acoustically acting on non-working intervals of the producing formation at the pressure drawdown mode in order to demud their near-bore-hole areas.

An analysis of different bore-hole jet devices shows that the reliability of their operation may be improved by increasing their functionality during surveying and testing wells.

It is identified that the above set of the elements used in the design of the bore-hole jet device enables to organize a sequence of actions during implementing the method for operating the bore-hole jet device, which ensures the most efficient use of the equipment installed on a pipe string during carrying out works on surveying, testing and development of producing formations in horizontal wells. The conditions are also created for obtaining full and reliable information on the condition of producing formations and for treating producing formations during a survey. The claimed bore-hole jet device enables to create a number of drawdown values with the use of a jet pump in the under-packer well area at a specific pressure differential, wash the well bottom for removing unattached propant, register pressures, temperatures and other physical parameters of a fluid pumped out of a well as well as the well itself by using a logging instrument, and register formation pressure restoration curves for the under-packer well area without using a special functional insert. At the same time, the possibility of monitoring a pressure drawdown value by controlling the pumping rate of an active working medium is provided. When testing formations, it is possible to adjust the mode of pumping out by changing a pressure of an active working medium supplied to the active nozzle of the jet pump. At the same time, the possibility of a working medium spontaneous overflow into the under-packer area is precluded when the jet pump is either operated or not operated.

Furthermore, the possibility of carrying out hydrofracturing or acid treatment of a formation is provided without preliminary installation of any functional inserts into the jet pump, thus saving time for their removal.

At the same time, the possibility of eliminating any inclination and jam of the sealing unit in the jet pump body during installation of the sealing unit on the seat in the stepped pass channel. For this purpose a guide separation bush is cantilever-installed in the jet pump body over the stepped pass channel coaxially to the pipe string. As a result, when a hydrofracturing liquid is supplied into a formation, no large mechanical impurities that may present into a hydrofracturing liquid may enter into the nozzle and the mixing chamber with a diffuser, and, consequently, the possibility of plugging the mixing chamber with a diffuser and the jet pump nozzle is precluded.

The same tasks are also solved due to the fact that the lower free end of the guide separation bush being from the upper end of the stepped pass channel at a distance S equal to 0.05-0.2 diameters $D_1$ of the upper end of the stepped pass channel, the inner diameter d of the guide separation bush being equal to 1.05 to 1.2 diameters $D_1$ from the upper end of the stepped pass channel, and the width h of the slit-like openings in the guide separation bush being not greater than the distance H between the adjacent slit-like openings, the diameter $D_2$ of the pass channel below the seat being from 0.90 to 0.96 of the diameter $D_1$ of the upper end of the stepped pass channel, and the diameter $D_3$ of the rigid logging cable being from 0.2 to 0.7 of the diameter $D_1$ of the upper end of the stepped pass channel.

Taking into account that a hydrofracturing liquid contains a propant, which is a refractory pellet-like material in the shape of balls having diameters in the range from 0.4 to 2.0 millimeters, it has been identified that at the above ratios of sizes for various types of jet pumps it becomes possible to prevent a propant from entering into the nozzle flow portion and into the mixing chamber with a diffuser, on one side, and, on the other side, preclude a great hydraulic resistance at the diffuser outlet which would interfere with the normal operation of the jet pump and would require significant energy resources for overcoming such hydraulic resistance.

The result is intensification of works on surveying, testing and developing wells, which enables to carry out quality surveys and tests of wells after drilling and during well-workover operations as well as prepare wells for operation by their complete surveys and tests in various modes, thus improving reliability of the bore-hole jet device.

DESCRIPTION OF THE BEST MODE FOR CARRYING OUT THE INVENTION

Figure 1:
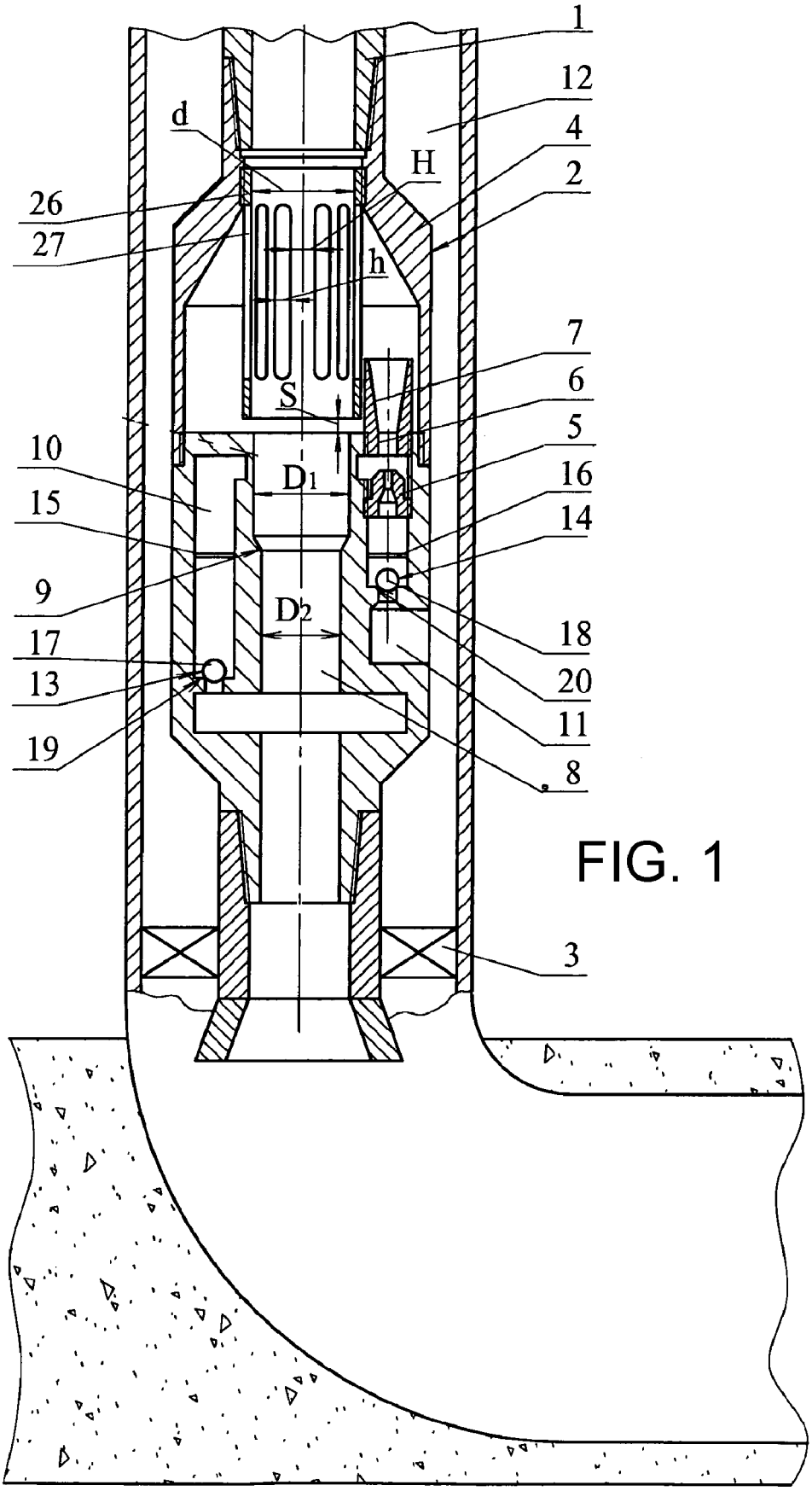
FIG. 1 shows a longitudinal section of the claimed bore-hole jet device when a hydrofracturing liquid or a chemical agent is pumped into a formation.
Figure 2:
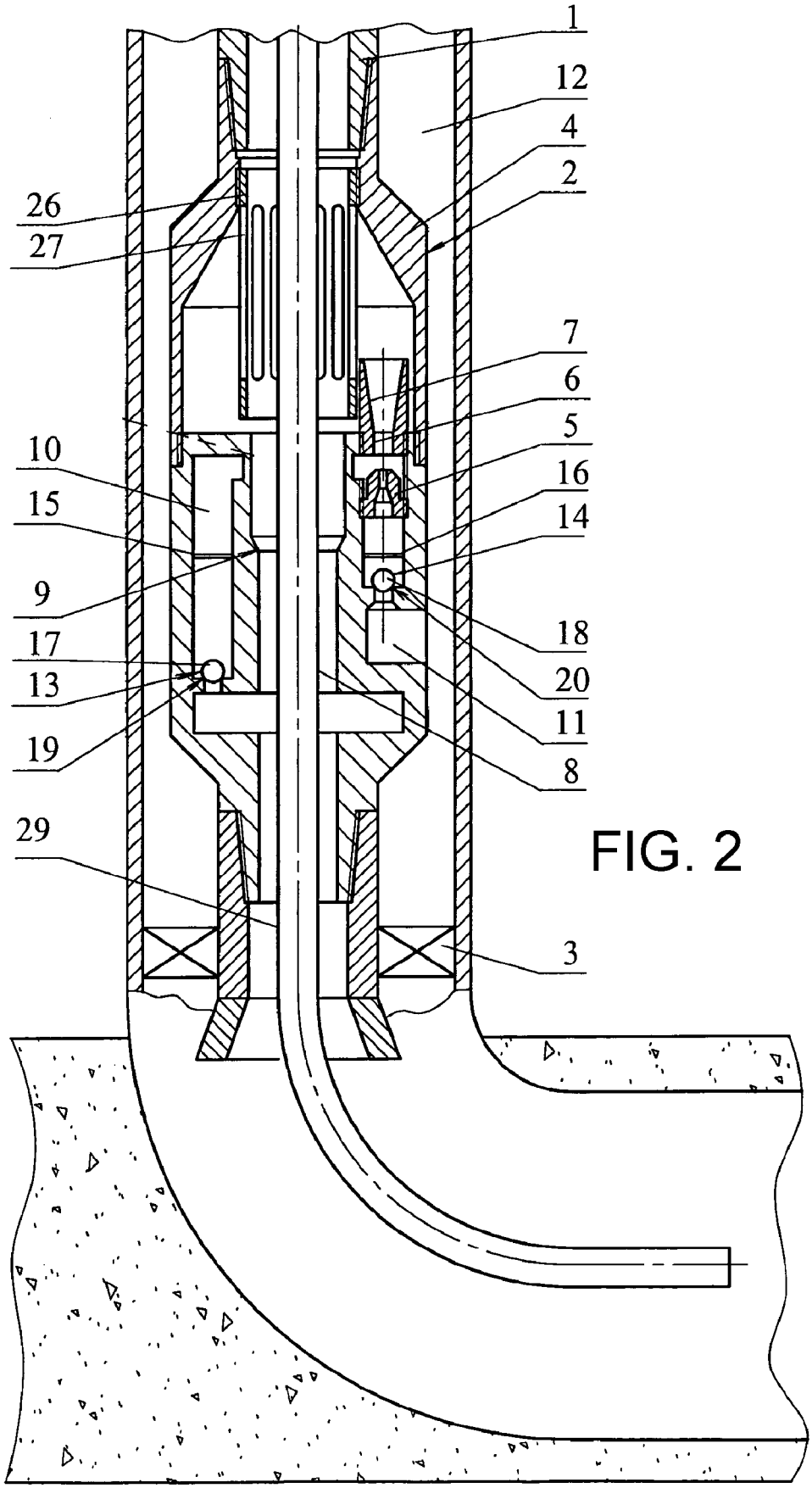
FIG. 2 shows a longitudinal section of the claimed bore-hole jet device when a well is washed with the use of a flexible tube.
Figure 3:
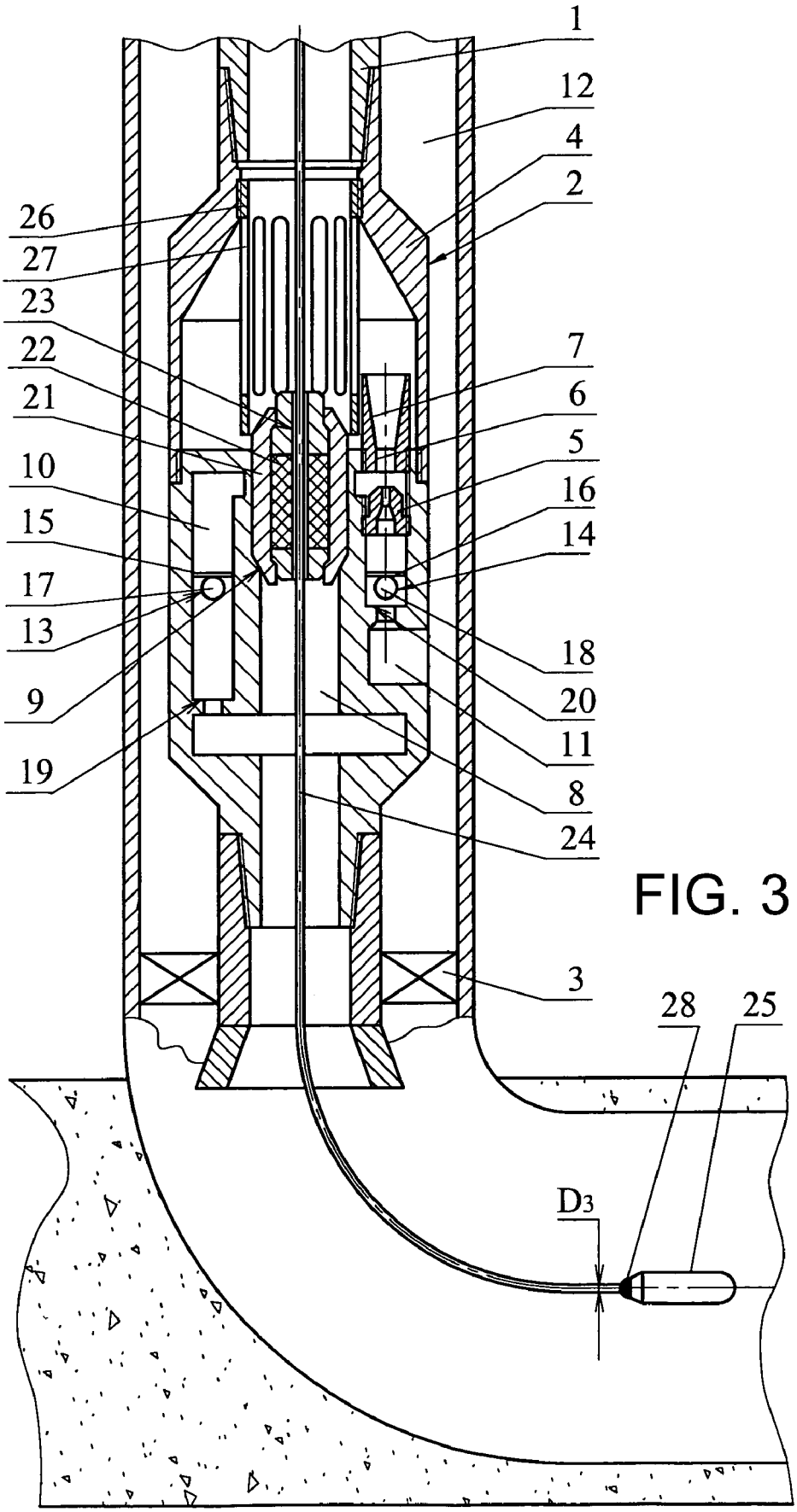
FIG. 3 shows a longitudinal section of the claimed bore-hole jet device when a sealing unit is arranged in the stepped pass channel for surveying and testing a well.
Figure 4:
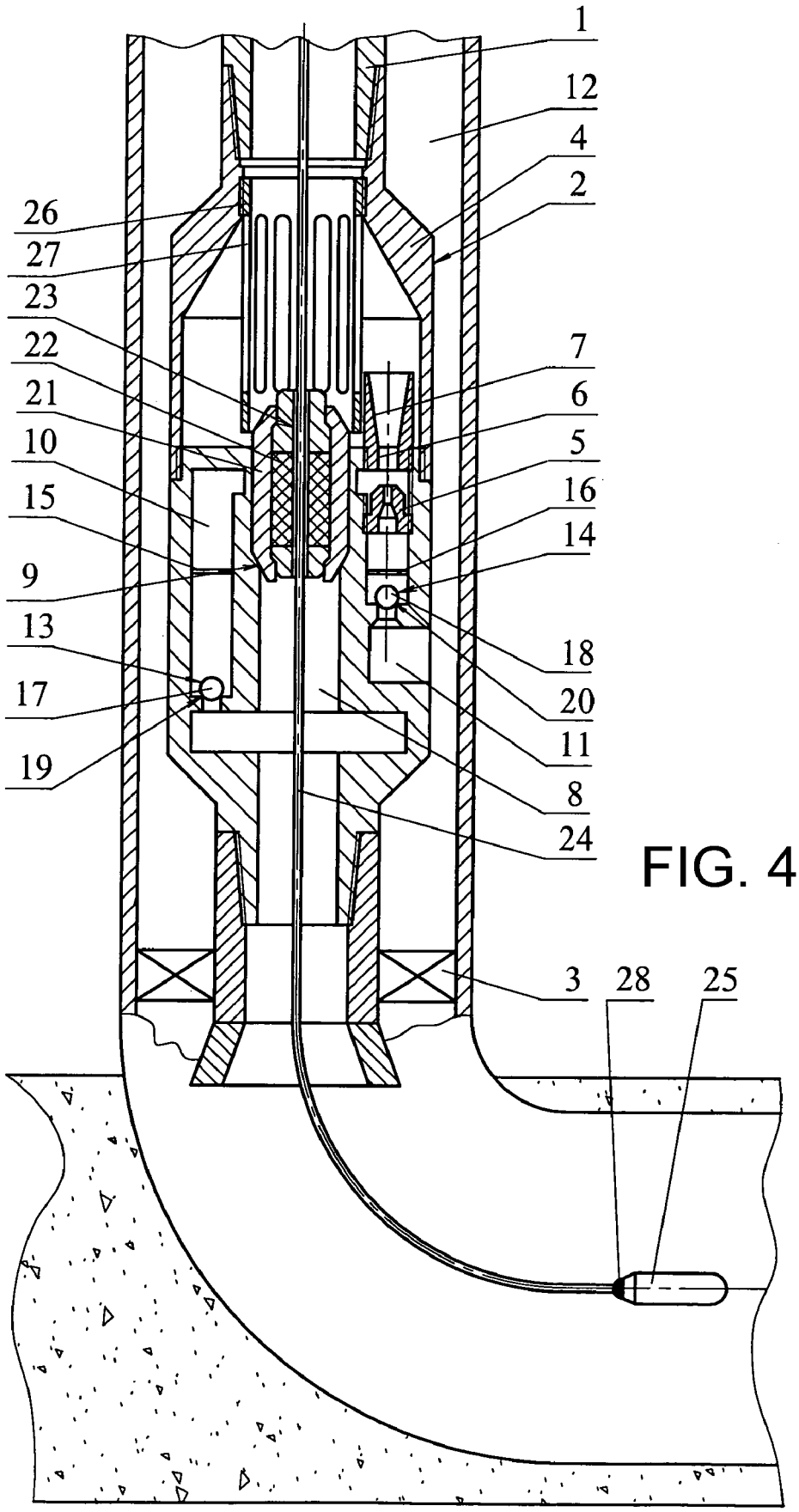
FIG. 4 shows a longitudinal section of the claimed bore-hole jet device when a formation pressure restoration curve is registered.

The bore-hole jet device comprises a jet pump 2 and a packer 3, which are installed on a pipe string 1. The body 4 of the jet pump 2 is provided with an active nozzle 5 and a mixing chamber 6 with a diffuser 7, which are arranged coaxially, as well as with a stepped pass channel 8 narrowing from top downwards and having a seat 9 between its steps, a channel 10 for supplying a fluid pumped out of a well, communicating with the stepped pass channel 8 below the seat 9, and a channel 11 for supplying an active working medium, communicating on its outlet with the active nozzle 5 and on its inlet with the hole annulus 12 around the pipe string 1. The stepped pass channel 8 is made coaxially to the pipe string 1 and communicates with it. The channel 10 for supplying a fluid pumped out of a well and the channel 11 for supplying an active working medium are each provided with a check valve 13, 14, respectively, and with a limit stop 15, 16 for upward movement of a shutoff member 17, 18, respectively, of the check valves 13 and 14, e.g., a ball, relative to the seat 19, 20 of the respective check valve 13, 14. The stepped pass channel 8 is made with the possibility of installing a sealing unit 21 into it, the sealing unit being made in the form of a hollow stepped cylindrical housing covering a sealing element 22, the latter being provided with an axial channel 23 for passing a rigid logging cable 24 therethrough, and a logging instrument 25 is suspended on the said cable via a cable head 28 below the body 4 of the jet pump 2. A cylindrical guide separation bush 26 is arranged above the stepped pass channel 8 and coaxially to it in the body 4 of the jet pump 2, wherein the said bush is cantilever-attached by its top end to the top portion of the jet pump body with the use of a threaded connection. Longitudinal slit-like openings 27 are made in the wall of the guide separation bush 26. The lower free end of the guide separation bush 26 is from the upper end of the stepped pass channel 8 at a distance S equal to 0.05-0.2 diameters $D_1$ of the upper end of the stepped pass channel 8. The inner diameter d of the guide separation bush 26 is equal to 1.05 to 1.2 diameters $D_1$ of the upper end of the stepped pass channel 8. The width h of the slit-like openings 27 in the guide separation bush 26 is not greater than the distance H between the adjacent slit-like openings 27. The diameter $D_2$ of the stepped pass channel below the seat is in the range from 0.90 to 0.96 of the diameter $D_1$ of the upper end of the stepped pass channel 8, and the diameter $D_3$ of the rigid logging cable 26 is in the range from 0.2 to 0.7 of the diameter $D_1$ of the upper end of the stepped pass channel 8.

The stepped pass channel 8 is made with the possibility of passing a flexible tube 29 through it via a pipe string 1 to the well bottom.

The claimed method of operating the bore-hole jet device for formation hydrofracturing and surveying horizontal wells includes assembling a pipe string 1 by arranging a jet pump 2 and a packer 3 on the pipe string 1. The assembly is lowered into a well, and the packer 3 is released. Then a hydrofracturing liquid or a chemical agent, e.g., an acid solution, is pumped via the pipe string 1 and the stepped pass channel 8 of the jet pump 2, after that the flexible tube 29 is passed through the pipe string 1 to the well bottom, and a liquid is pumped through the flexible tube 29 for washing unattached propant from the well bottom. After completion of washing the flexible tube 29 is removed from the well, and the sealing unit 21 put on the rigid logging cable 24 and the logging instrument 25 attached to the rigid logging cable 24 via the cable head 28 are lowered into the well. The sealing unit 21 is installed on the seat 9 in the stepped pass channel 8 of the jet pump 2. During lowering the logging instrument 25 it is used for registering background values of geophysical fields, in particular thermal fields, from the inlet funnel of the pipe string 1 to the bottom of the horizontal well. The logging instrument 25 is positioned in the area of a producing formation in the well, after which a pressure drawdown to the producing formation is created with the use of the jet pump 2 by supplying a working medium via the hole annulus 12 around the pipe string 1 to the active nozzle 5, thus draining the producing formation by removing the hydrofracturing liquid with unattached propant or reaction products resulting from treating the formation with a chemical agent, e.g., with an acid solution. During draining a bottom pressure and a well flow rate are regularly measured, then the logging instrument 25 on the rigid logging cable 24 is raised to the inlet funnel of the pipe string, measuring current values of physical fields in rocks and of a formation fluid coining into the well. Then while the jet pump 2 is operated, the logging instrument 25 is lowered and raised at least three times at different values of pressure drawdown to the formation, and current values of the physical fields in rocks and of the formation fluid coining into the well are registered, the said parameters being registered at different pressures of the working medium supply to the active nozzle and at different lowering and raising speeds of the logging instrument 25. Then the logging instrument 25 is positioned in the area of the producing formation, the supply of the working medium into the active nozzle 5 of the jet pump 2 is abruptly stopped, thus ensuring closure of the check valves 13, 14 and separating the above-packer hole annulus 12 and the inner cavity of the pipe string 1 above the sealing unit 21 from the under-packer area, and the logging instrument 25 is used for registering formation pressure restoration curves in the well space under the packer, registration results are used for making a conclusion on preparedness of the well for being transferred into the operation mode, and then the logging instrument 25 together with the sealing unit 21 are removed from the well by using the rigid logging cable 24.

After removing the logging instrument 25 from the well, the rigid logging cable 24 may be used for lowering an ultrasonic transmitter (not shown in the drawings) into the well for the purpose of acoustically acting on non-working intervals of the producing formation at the pressure drawdown mode in order to demud their near-borehole areas.

INDUSTRIAL APPLICABILITY

This invention may be used in the oil-and-gas industry for developing wells after drilling or for carrying logging operations in any types of wells.

What is claimed is:

1. A bore-hole jet device for formation hydrofracturing and surveying horizontal wells, comprising a jet pump and a packer, which are arranged on a pipe string, an active nozzle and a mixing chamber with a diffuser being coaxially arranged in a body of the jet pump, the jet pump body being also provided with a stepped pass channel narrowing from top downwards and having a seat between the steps of the stepped pass channel, a channel for supplying a fluid pumped out of a well in communication with the stepped pass channel below the seat, and a channel for supplying an active working medium in communication on an outlet side with the active nozzle and on an inlet side with a hole annulus around the pipe string, the stepped pass channel being made coaxially to the pipe string and communicating with it, the channel for supplying a fluid pumped out of a well and the channel for supplying an active working medium being each provided with a check valve and with a limit stop for a shutoff member of the check valve, when each check valve member moves upward to a respective seat of the respective check valve, the stepped pass channel being made with the possibility of installing a sealing unit made as a hollow stepped cylindrical housing covering a sealing element, the sealing element being provided with an axial channel for passing a rigid logging cable therethrough, on which a logging instrument is suspended via a cable head below the jet pump body, a cylindrical guide separation bushing is arranged above the stepped pass channel and coaxially to it in the jet pump body, the bushing being cantilever-attached by its top end to the top portion of the jet pump body with the use of a threaded connection, longitudinal slit-like openings are made in the wall of the guide separation bushing, the lower free end of the guide separation bushing being spaced from the upper end of the stepped pass channel at a distance S equal to 0.05-0.2 diameters $D_1$ of the upper end of the stepped pass channel, the inner diameter d of the guide separation bushing being equal to 1.05 to 1.2 diameters $D_1$ of the upper end of the stepped pass channel, and the width h of the slit-like openings in the guide separation bushing being not greater than the distance H between the adjacent slit-like openings, the diameter $D_2$ of the pass channel below the seat being in the range from 0.90 to 0.96 of the diameter $D_1$ of the upper end of the stepped pass channel, and the diameter $D_3$ of the rigid logging cable being in the range from 0.2 to 0.7 of the diameter $D_1$ of the upper end of the stepped pass channel.

2. A bore-hole jet device according to claim 1, wherein the stepped pass channel is made with the possibility of passing a flexible tube therethrough via the pipe string down to the well bottom.

3. A method for operating the bore-hole jet device for formation hydrofracturing and surveying horizontal wells, comprising assembling a pipe string by arranging a jet pump and a packer on the pipe string, lowering the assembly into a well, and releasing the packer, then pumping a hydrofracturing liquid or a chemical agent, via the pipe string and a stepped pass channel of the jet pump, after that passing a flexible tube through the pipe string to the well bottom, and pumping a liquid through the flexible tube for washing unattached proppant from the well bottom; then removing the flexible tube from the well, and putting a sealing unit on a rigid logging cable and attaching a logging instrument to the rigid logging cable via a cable head and lowering into the well; installing the sealing unit on the seat in the jet pump stepped pass channel, and using the logging instrument for registering background values of geophysical fields, in particular thermal fields, from an inlet funnel of the pipe string to the bottom of the horizontal well during lowering of the logging instrument; then positioning the logging instrument in the area of a producing formation in the well, and creating a pressure drawdown to that producing formation with the use of the jet pump by supplying a working medium via the hole annulus around the pipe string to an active nozzle, thus draining the producing formation by removing the hydrofracturing liquid with unattached proppant or reaction products resulting from treating the formation with a chemical agent, regularly measuring during draining a bottom pressure and a well flow rate; then raising the logging instrument on the rigid logging cable to the inlet funnel of the pipe string, measuring current values of physical fields in rocks and of a formation fluid coming into the well; then, while the jet pump is operated, lowering and raising the logging instrument at least three times at different values of pressure drawdown to the formation, and registering current values of the physical fields in rocks and of the formation fluid coming into the well, the said parameters being registered at different pressures of the working medium supply to the active nozzle and at different lowering and raising speeds of the logging instrument; then positioning the logging instrument in the area of the producing formation, abruptly stopping the supply of the working medium into the jet pump active nozzle, thus ensuring closure of a plurality of check valves and separating the above-packer hole annulus and the inner cavity of the pipe string above the sealing unit from the under-packer area, and using the logging instrument for registering formation pressure restoration curves in the well space under the packer; using registration results are used for making a conclusion on preparedness of the well for being transferred into an operation mode, and then removing the logging instrument together with the sealing unit from the well by using the rigid logging cable.

4. A method according to claim 3, further comprising, after removing the logging instrument from the well, lowering an ultrasonic transmitter on the rigid logging cable is lowered into the well for the purpose of acoustically acting on non-working intervals of the producing formation at the pressure drawdown mode in order to demud their near-borehole areas.

* * * * *